US008523622B2

(12) United States Patent
Grimes

(10) Patent No.: US 8,523,622 B2
(45) Date of Patent: Sep. 3, 2013

(54) FIRE/WATER RESCUE SLED FOR HANDICAPPED AND ELDERLY

(76) Inventor: Wanda Grimes, Columbus, GA (US)

( * ) Notice: Subject to any disclaimer, the term of this patent is extended or adjusted under 35 U.S.C. 154(b) by 38 days.

(21) Appl. No.: 12/950,834

(22) Filed: Nov. 19, 2010

(65) Prior Publication Data

US 2011/0177733 A1 Jul. 21, 2011

Related U.S. Application Data

(60) Provisional application No. 61/263,278, filed on Nov. 20, 2009.

(51) Int. Cl.
*B63C 9/00* (2006.01)

(52) U.S. Cl.
USPC ..... 441/80; 2/81; 2/458; 296/20

(58) Field of Classification Search
USPC ..... 441/80, 82, 83; 296/20; 5/86.1; 2/456, 457, 458, 81, 84, 85, 93, 97
See application file for complete search history.

(56) References Cited

U.S. PATENT DOCUMENTS

| | | | | |
|---|---|---|---|---|
| 2,972,755 | A | 2/1961 | Abel | |
| RE28,916 | E * | 7/1976 | Rice et al. | 5/628 |
| 4,579,381 | A | 4/1986 | Williams | |
| 4,621,382 | A | 11/1986 | Burriss et al. | |
| 4,717,362 | A * | 1/1988 | Kraft | 441/82 |
| 4,956,218 | A * | 9/1990 | Haining | 428/102 |
| 5,318,018 | A * | 6/1994 | Puma et al. | 128/202.11 |
| 5,628,066 | A * | 5/1997 | Gottlieb et al. | 2/84 |
| 8,091,144 | B2 * | 1/2012 | Sigmon et al. | 2/458 |
| 2002/0010529 | A1 | 1/2002 | Molden | |
| 2008/0276357 | A1 * | 11/2008 | Sigmon et al. | 2/458 |

OTHER PUBLICATIONS

International Search Report and Written Opinion, mailed Jan. 20, 2011 in Application No. PCT/US2010/057497, filed Nov. 19, 2010.

* cited by examiner

*Primary Examiner* — Lars A Olson
(74) *Attorney, Agent, or Firm* — Kilpatrick Townsend & Stockton LLP

(57) ABSTRACT

A rescue appliance for evacuating physically-compromised persons is disclosed. A rescue appliance includes a platform configured to support a prone evacuee, a set of wheels coupled with the platform to support the platform relative to a floor surface, and a protection assembly coupled with the platform. The protection assembly is configurable to surround the prone evacuee to protect the evacuee from a fire. The protection assembly can be configured to encase the prone evacuee. The rescue appliance can be configured to be sufficiently buoyant to support an evacuee on water to allow evacuation in a flooding emergency. Two or more rescue appliances can be coupled together to form a train so that multiple persons can be evacuated simultaneously.

20 Claims, 7 Drawing Sheets

FIRE/WATER RESCUE SLED FOR HANDICAPPED AND ELDERLY

CROSS-REFERENCES TO RELATED APPLICATIONS

This application claims the benefit of U.S. Provisional Application No. 61/263,278, entitled "Fire/Water Rescue Sled for Handicapped and Elderly," filed Nov. 20, 2009 , the entire disclosure of which is hereby incorporated herein by reference.

BACKGROUND

Various embodiments described herein relate generally to appliances for evacuating a physically-compromised person, and more particularly for appliances for evacuating a handicapped and/or elderly person from a fire or flood emergency. Such an appliance can be kept nearby to the physically-compromised person so as to be readily available if an emergency evacuation situation arises.

Moving a handicapped and/or elderly person can be challenging in normal situations, and can be especially challenging in emergency situations. A handicapped/elderly person may not be able to walk, or even crawl, and thereby may require considerable assistance to move from location to location. Some handicapped/elderly persons may also weigh significantly more than what can be managed by their caregiver (s). An emergency situation, such as a fire, often complicates the situation, for example, by adding smoke and heat as additional obstacles to be dealt with. In a fire emergency, it may be necessary to stay close to the floor so as to avoid exposure to smoke. One existing method for a care giver to get a patient out of a burning home or care facility today is to put a sheet or blanket on the floor, put the patient on it, and drag the patient out. To drag the patient out, the care giver must stand, albeit somewhat bent over at the waist. However, if the smoke gets below the care giver's face so that the care giver can no longer breathe, the care giver may abandon the patient, get on the floor, and crawl out as fast as possible. Such a reaction may be understandable given the situation. Imagine the difficulty of getting a relatively heavy patient out of a burning building this way. In addition to a fire emergency, a flooding emergency can also present additional obstacles to be dealt with when evacuating a handicapped and/or elderly person.

Recent emergencies, such as major hurricanes, have resulted in the injury or death of handicapped and/or elderly persons that may have been avoided if more effective means were available to evacuate such persons from danger. Accordingly, it is desirable to develop more effective means to evacuate a physically-compromised person(s) from danger, particularly from all-to-common emergencies like fires and floods.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Rescue appliances in accordance with various aspects and embodiments are provided for use in evacuating a physically-compromised person (e.g., a handicapped person, an elderly person) in an emergency situation. The disclosed appliances can be used to support the evacuee in a prone position close to the floor, which helps to avoid overhead smoke in a fire emergency. In many embodiments, the disclosed appliances include a protection assembly that is configurable to surround (and in many embodiments encase) the prone evacuee to protect the evacuee from a fire. In many embodiments, the protection assembly holds the prone evacuee in place so as to prevent the evacuee from falling off of the rescue appliance. The disclosed appliances can include wheels, which make it easier for a care giver to move the evacuee over the floor. The disclosed appliances can also be sufficiently buoyant, for example, via a buoyant perimeter member, so that the appliance can be used in a flooding emergency. Such appliances can be kept nearby physically-compromised persons for use in an emergency, which may serve to significantly decrease related injuries and/or death of handicapped and/or elderly persons in such emergency situations.

Thus, in a first aspect, a rescue appliance is provided. The rescue appliance includes a platform configured to support a prone evacuee, a set of wheels coupled with the platform to support the platform relative to a floor surface, and a protection assembly coupled with the platform. The protection assembly is configurable to surround the prone evacuee to protect the evacuee from a fire.

In many embodiments, the rescue appliance includes one or more additional features. For example, the rescue appliance can include a plurality of carrying handles coupled with the platform. The rescue appliance can include a towing tension member (e.g., a strap, a rope, a cable, a chain, a lanyard, etc.) coupled with the platform for pulling the rescue appliance over the floor surface. The rescue appliance can include a coupling feature to couple the rescue appliance with a second rescue appliance so, for example, a care giver(s) can pull two (or more) evacuees to safety simultaneously. Each of the wheels can include a castoring mechanism. Each of the wheels can be retractable to permit the rescue appliance to be slid up or down stairs.

In many embodiments, the rescue appliance is configured to support an evacuee in a prone position close to the floor level. For example, in many embodiments the rescue appliance is configured to elevate the evacuee by less than twelve inches relative to the floor surface. In many embodiments, the rescue appliance is configured to elevate the evacuee by less than six inches relative to the floor surface.

In many embodiments, the protection assembly is configurable to surround the evacuee with fire-resistant material. For example, the protection assembly can include a base portion comprising fire-resistant material disposed on top of the platform so as to be disposed between the evacuee and the platform, a first longitudinally-oriented flap comprising fire-resistant material, and a second longitudinally-oriented flap comprising fire-resistant material. The first flap is coupled with a first longitudinal side of the base portion and is configurable to at least partially cover the evacuee. The second flap is coupled with a second longitudinal side of the base portion and is configurable to overlap with the first flap so that the evacuee is surrounded by the base portion, the first flap, and the second flap. The first and second flaps can include a plurality of complementary attachment features configured and positioned to secure the second flap relative to the first flap when the first and second flaps cover the evacuee. For example, the complementary attachment features can include a hook and loop type fastener. The complementary attachment features can include a tie-down strap. The first and second flaps can include regions configured to cover the evacuee's head and protect the evacuee's head from the fire while allowing the evacuee to breathe. The head covering regions can include a fire-resistant material sufficiently permeable to air to allow the evacuee to breathe through the head covering regions. In many embodiments, the protection assembly is configured to encase the evacuee.

In many embodiments, the rescue appliance is sufficiently buoyant to support the evacuee on water. For example, the rescue appliance can include a buoyant perimeter member. The buoyant perimeter member can be removably coupled with the platform. The rescue appliance can include an inflatable member. The protection assembly can include an inflatable member.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 1:
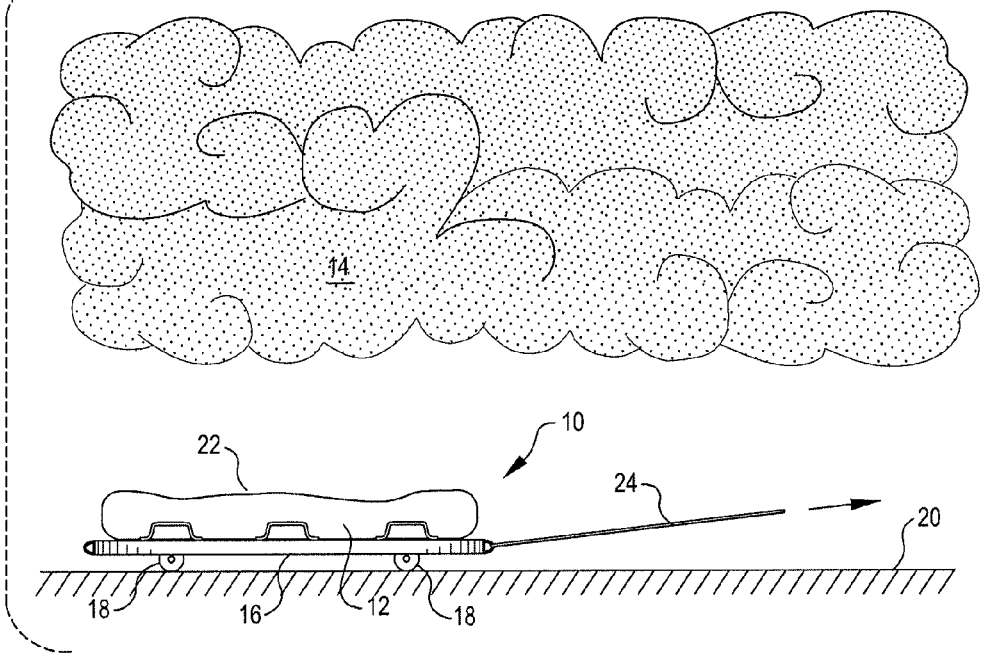
FIG. 1 illustrates the use of a rescue appliance to evacuate a physically-compromised person from a smoke-filled room, in accordance with many embodiments.

Referring now to the drawings, in which like reference numerals represent like parts throughout the several views, FIG. 1 diagrammatically illustrates the use of a rescue appliance 10 to evacuate a physically-compromised person 12 from a smoke-filled room 14, in accordance with many embodiments. The rescue appliance 10 includes a platform 16 configured to support a prone evacuee, a set of wheels 18 coupled with the platform 16 to support the platform 16 relative to a floor surface 20, and a protection assembly 22 coupled with the platform 16. The protection assembly 22 is configured to surround the prone evacuee to protect the evacuee from the fire. In many embodiments, the protection assembly 22 is configured to encase the evacuee. In many embodiments, castoring wheels are used so that the rescue appliance 10 can be moved over the floor surface 20 in any desired direction. A towing tension member 24 (e.g., a strap, a rope, a cable, a chain, a lanyard, etc.) is coupled with an end of the rescue appliance 10, and can be used to pull the rescue appliance 10 along the floor surface 20. The towing tension member 24 can be coupled with a suitable harness feature (e.g., a loop) that can be coupled with a rescuer, for example, around the rescuer's waist and/or shoulder(s), so as to free the rescuer's hands for crawling. In operation, the evacuee is placed on the platform 16 in the prone position and is surrounded (and in many embodiments encased) using the protection assembly 22. A rescuer (e.g., a caregiver, an emergency responder, etc) can then crawl along the floor 20 while pulling the rescue appliance 10 behind via the towing tension member 24. The ability to crawl along the floor enhances the rescuer's chances of avoiding smoke, thereby enhancing the likelihood of a successful evacuation.

Figure 2:
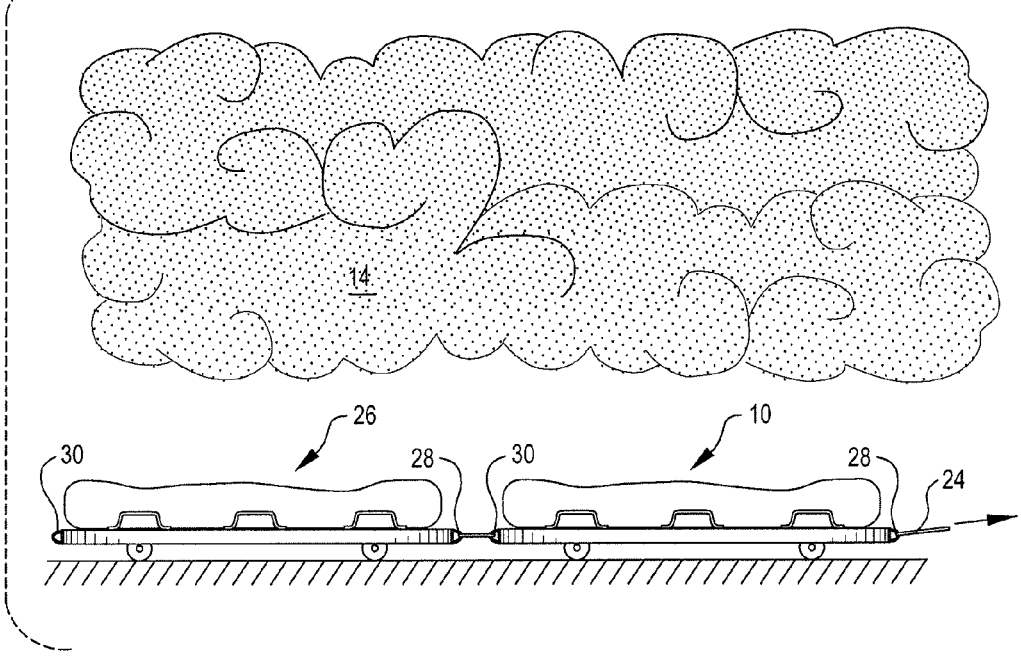
FIG. 2 illustrates the use of two coupled rescue appliances to evacuate two physically-compromised persons from a smoke-filled room simultaneously, in accordance with many embodiments.

Two or more rescue appliances can be coupled together to form a train, thereby enabling the simultaneous evacuation of two or more persons. FIG. 2 diagrammatically illustrates the use of two coupled rescue appliances 10, 26 to evacuate two physically-compromised persons from a smoke-filled room 14, in accordance with many embodiments. Each rescue appliance 10, 26 is equipped with both a front end coupling feature 28 and a back end coupling feature 30, which can be used to link the rescue appliances 10, 26 into a train configuration. A rescuer(s) can then pull on the towing tension member 24 coupled with the front end coupling feature 28 of the front rescue appliance 10 so as to pull the two evacuees to safety. Two or more rescue appliances can be linked together in such a fashion, and one or more rescuers can pull the resulting train via the towing tension member 24.

Figure 3:
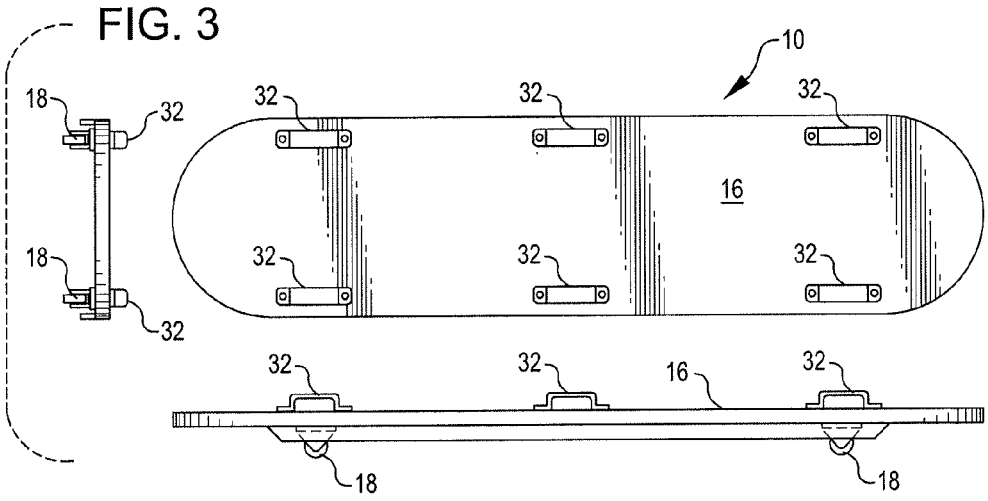
FIG. 3 illustrates top, side, and front views of a rescue appliance (shown without a protection assembly) in accordance with many embodiments.

FIG. 3 diagrammatically illustrates top, side, and front views of a rescue appliance 10 (shown without the protection assembly 22) in accordance with many embodiments. The rescue appliance 10 includes the platform 16, the set of wheels 18 coupled with the platform 16 to support the platform 16 relative to the floor surface, a plurality of carrying handles 32 coupled with the platform, and the protection assembly (not shown). When in use, the evacuee is placed in a prone position on the platform 16 between the carrying handles 32, and then surrounded (and in many embodiments encased) with the protection assembly. In the embodiment shown, the rescue appliance 10 includes six carrying handles 32, which permits, for example, six rescuers to jointly lift an evacuee via the rescue appliance 10. The platform is appropriately configured to react the associated applied forces that arise, for example, when the evacuee and rescue appliance are towed along the floor and when the evacuee is carried via the rescue appliance 10.

Any suitable material can be used to make the rescue appliance 10. For example, the platform 16 can be fabricated from fiberglass, aluminum, or any other suitable structural material with sufficient strength and rigidity. Preferably, the materials used to make the rescue appliance 10 are sufficiently non-flammable and non-heat conducting so as to provide the evacuee with sufficient shielding from fire related hazards. Additionally, the rescue appliance 10 is preferably configured to be relatively light weight for ease of use by a rescuer(s). For example, the platform 16 can be constructed using a composite material(s) (e.g., fiberglass, graphite, etc.) and a core member (e.g., honeycomb, wood, foam, etc.) so as to provide a light-weight, strong, and relatively rigid platform. The core member can be limited in size to be disposed in the central region of the platform so as to provide for solid laminate construction around the periphery of the platform. Known wheel assemblies can be attached (e.g., bolted) to the platform 16, for example, to a solid laminate portion of the platform in many embodiments. The rescue appliance 10 can be configured with retractable wheel assemblies so that the wheels 18 can be retracted to, for example, enhance the ability of a rescuer to slide the rescue appliance 10 up or down stairs. Likewise, the carrying handles 32 can be attached (e.g., bolted, bonded, etc) to the platform 16, for example, to a solid laminate portion of the platform in many embodiments.

Figure 4A:
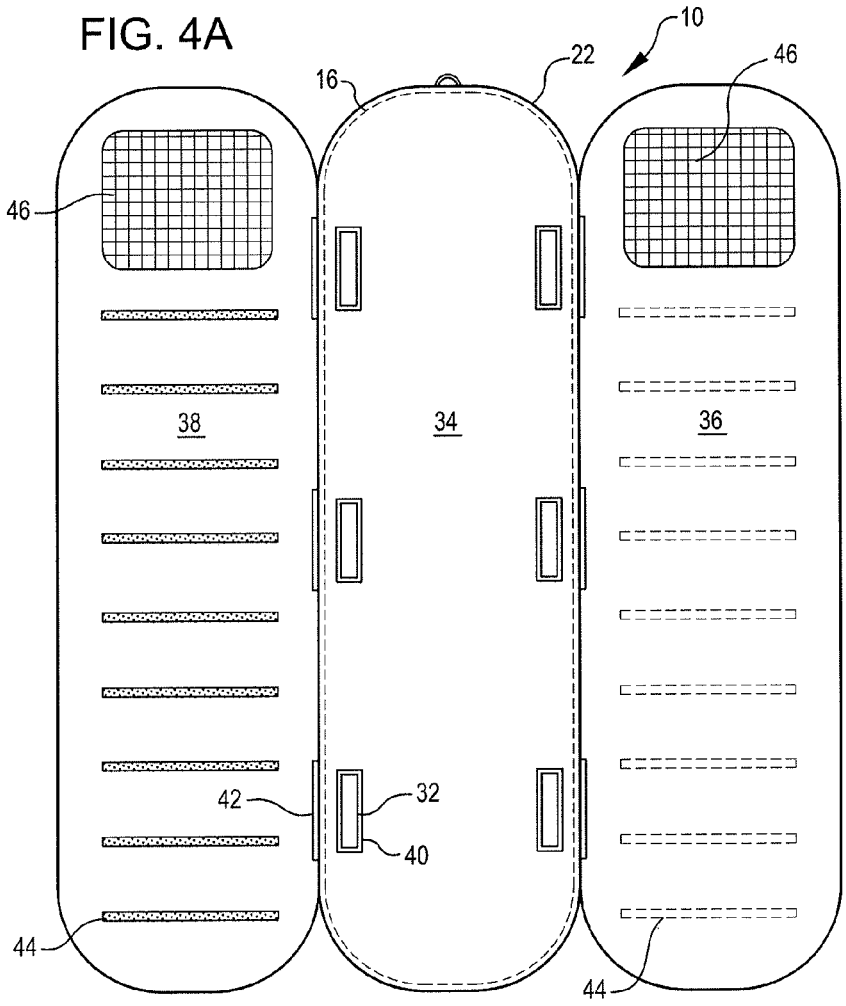
FIG. 4A illustrates a top view of a rescue appliance in an evacuee receiving configuration, in accordance with many embodiments.

In many embodiments, a protection assembly made from a fire-resistant material(s) is coupled with the rescue appliance. FIG. 4A diagrammatically illustrates a top view of a rescue appliance 10 in an evacuee receiving configuration, in accordance with many embodiments. The rescue appliance 10 includes an attached protection assembly 22 that includes a base portion 34, a first longitudinally-oriented flap 36, and a second longitudinally-oriented flap 38. The protection assembly 22 can be made from a fire-resistant material. The protection assembly 22 can be attached to the platform using any suitable approach (e.g., glue, mechanical attachment, etc.).

The base portion 34 is disposed on top of the platform 16 so as to be disposed between the evacuee and the platform 16. The base portion 34 can include clearance openings 40 for the carrying handles 32. The base portion 34 can be attached to the platform 16 using any suitable approach (e.g., glue, mechanical attachment, etc.).

Each of the first flap 36 and the second flap 38 are attached to the base portion 34 and/or the platform 16 along the length of the flaps 36, 38 (e.g., by sewing, by mechanical fasteners, other suitable means). The flaps 36, 38 can include areas not attached to the base portion 36 to form openings 42 that can be used to access the adjacent carrying handles 32 when the flaps 36, 38 are folded to cover the evacuee. The flaps 36, 38 can include a plurality of hook and loop type fastener strips 44 configured and positioned to mate with each other to secure the flaps 36, 38 when covering an evacuee. Each of the flaps 36, 38 can include a head covering region 46 to protect the evacuee's head from the fire while allowing the evacuee to breathe. For example, the head covering regions 46 can be made from a fire-resistant material sufficiently permeable to air to allow the evacuee to breathe through the head covering regions 46.

Figure 4B:
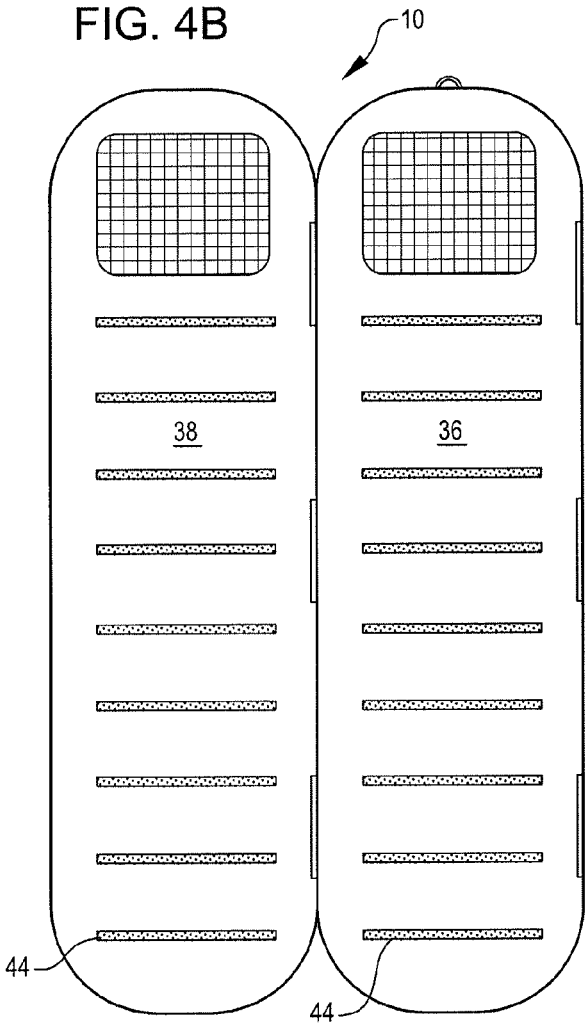
FIG. 4B illustrates a top view of the rescue appliance of FIG. 4A showing a first side flap positioned over an evacuee, in accordance with many embodiments.
Figure 4C:
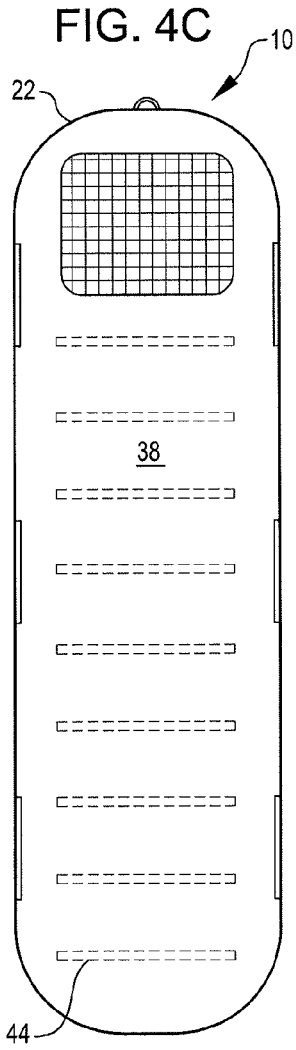
FIG. 4C illustrates a top view of the rescue appliance of FIGS. 4A and 4B in an evacuee protecting configuration, in accordance with many embodiments.

To evacuate a person using the rescue appliance 10, the rescue appliance 10 is placed on the floor in the configuration shown in FIG. 4A. Next, the evacuee is placed onto the platform 16 on top of the base portion 34 in a prone position. The first flap 36 is then folded over the evacuee, thereby placing the rescue appliance 10 into the configuration illustrated in FIG. 4B. The second flap 38 is then folded over the first flap 36, thereby placing the rescue appliance 10 into the configuration illustrated in FIG. 4C. Folding the second flap 38 over the first flap 36 causes engagement between the fastener strips 44, which can be pressed together to ensure a desired level of engagement between the fastener strips 44. The evacuee is now wrapped within the protection assembly, thereby serving to protect the evacuee from fire related injury during the evacuation process. In many embodiments, the protection assembly further serves to hold the prone evacuee in place so as to prevent the evacuee from falling off of the rescue appliance. The rescue appliance can now be used to tow, carry, float, and/or slide the evacuee to safety.

In many embodiments, the rescue appliance 10 can be used to evacuate a physically-comprised person in a flooding emergency by being sufficiently buoyant to support the evacuee on water. For example, the platform 16 can be configured to be sufficiently buoyant to support the evacuee and/or an additional buoyant member (e.g., a buoyant perimeter member) can be used to supply any additional level of buoyancy required.

Figure 5A:
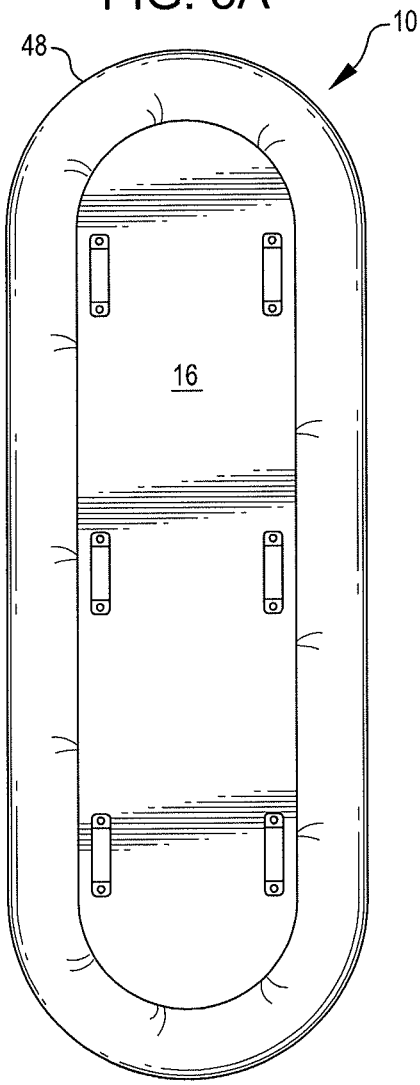
FIGS. 5A and 5B illustrate top and side views of a rescue appliance having a buoyant perimeter member, in accordance with many embodiments.
Figure 5B:
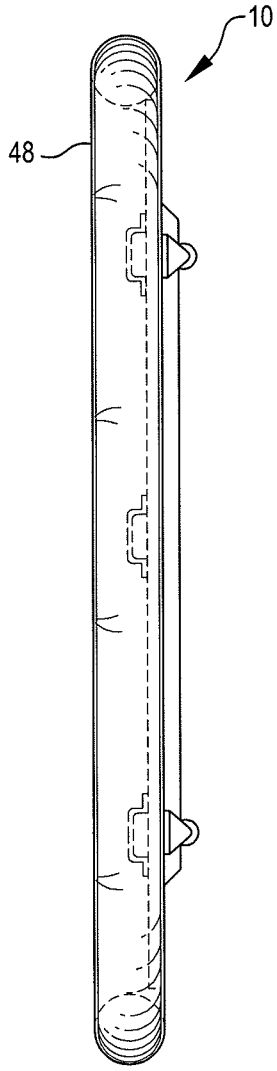

FIGS. 5A and 5B diagrammatically illustrate top and side views of a rescue appliance 10 having a buoyant perimeter member 48, in accordance with many embodiments. The buoyant perimeter member 48 can be formed in any suitable fashion (e.g., from a buoyant material such as foam, as an inflatable member, etc.). The buoyant perimeter member 48 can be attached directly to the perimeter of the platform 16, can be attached directly to the protection assembly, and/or can be integral to the protection assembly. For example, the protection assembly can include an inflatable perimeter member that can be manually or automatically inflated (e.g., via a manual pump, via a carbon-dioxide cartridge, etc.). The use of a buoyant perimeter may be preferred so as to provide enhanced stability when the rescue appliance 10 is used to support an evacuee on water.

Prototype Rescue Appliance

Figure 6:
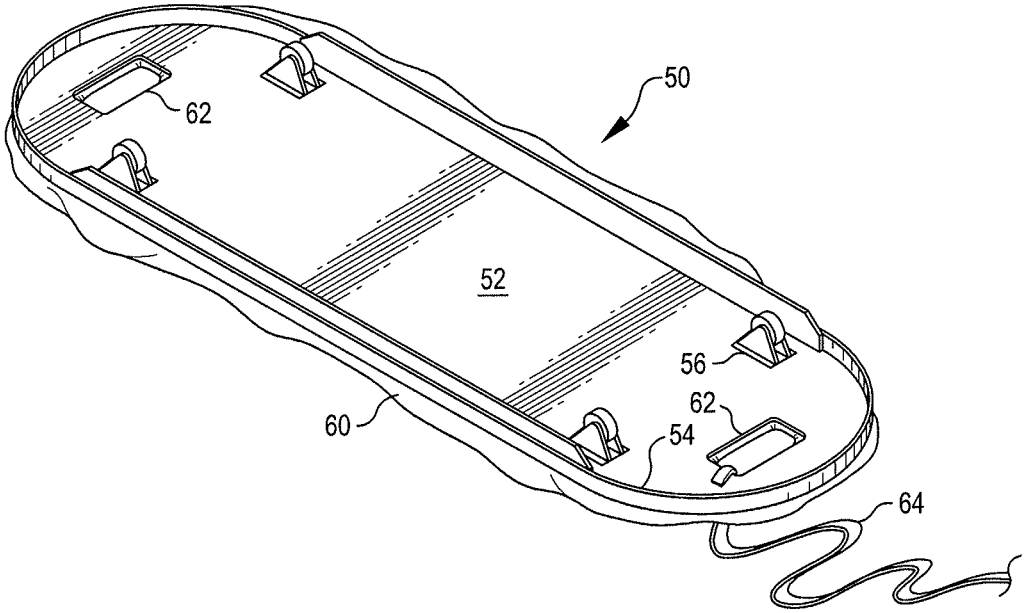
FIG. 6 illustrates the underside of a prototype rescue appliance in accordance with many embodiments.

FIGS. 6 through 9 illustrate a prototype rescue appliance 50, in accordance with many embodiments. FIG. 6 illustrates the underside of the prototype rescue appliance 50. As shown in FIG. 6, the rescue appliance 50 includes a platform 52 constructed from sheet aluminum. The platform 52 includes a perimeter flange 54, which was attached to the central portion of the platform via welding. Castoring wheel assemblies 56 were bolted to the platform 52, four carrying handles 58 (shown in FIG. 7) were bolted to the platform 52, and a protection assembly 60 made from fire-resistant material was attached to the platform 52. Openings 62 were formed in both ends of the platform 52 for use as attachment features by which the rescue appliance 50 can be towed via a towing tension member 64, or by which the rescue appliance 50 can be coupled with one or more additional rescue appliances to form a rescue appliance train.

Figure 7:
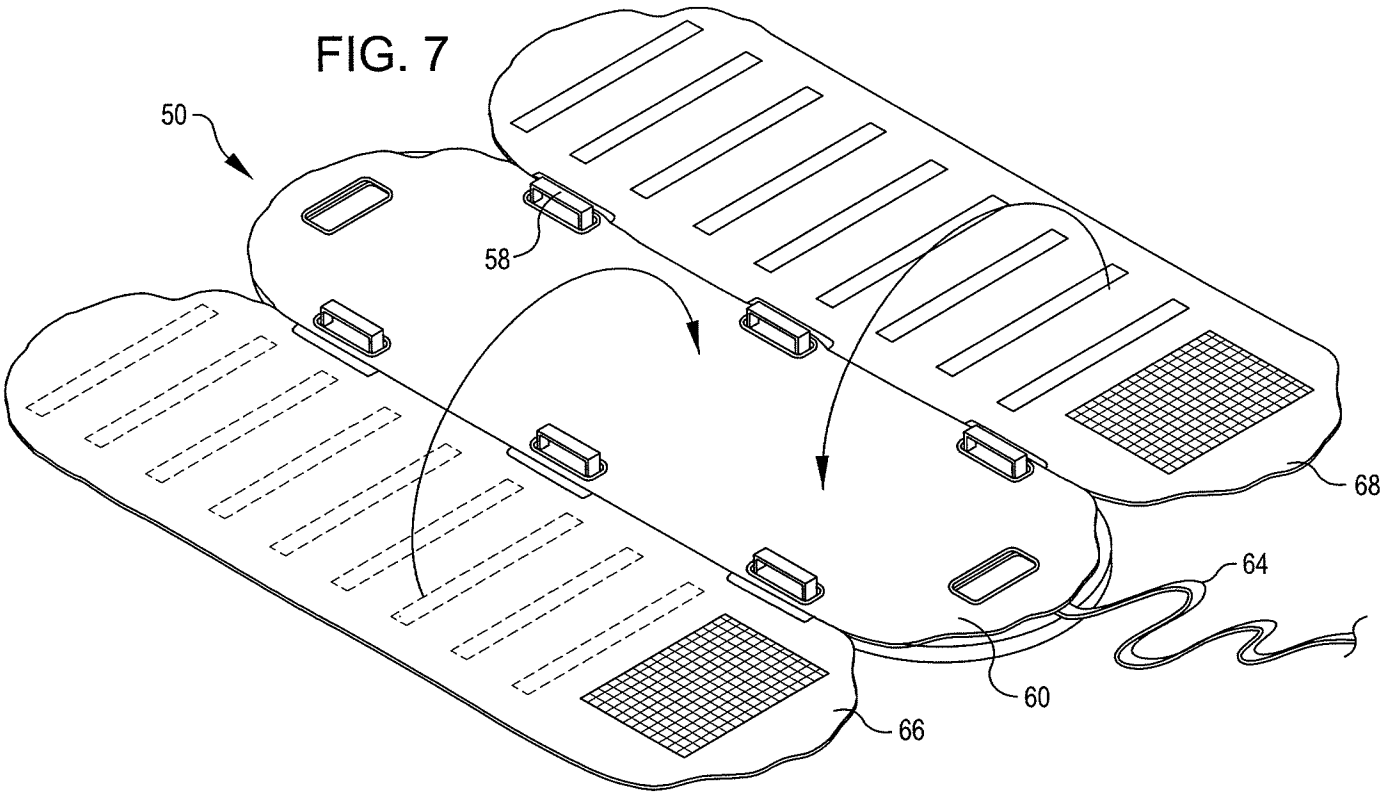
FIG. 7 further illustrates the prototype rescue appliance of FIG. 6, showing the rescue appliance in an evacuee receiving configuration, in accordance with many embodiments.

FIG. 7 further illustrates the prototype rescue appliance 50 of FIG. 6, showing the rescue appliance 50 in an evacuee receiving configuration, in accordance with many embodiments. As describe above, the rescue appliance 50 can be placed on the ground and side flaps 66, 68 of the protection assembly 60 can be arranged as shown to prepare the rescue appliance 50 to receive an evacuee.

Figure 8:
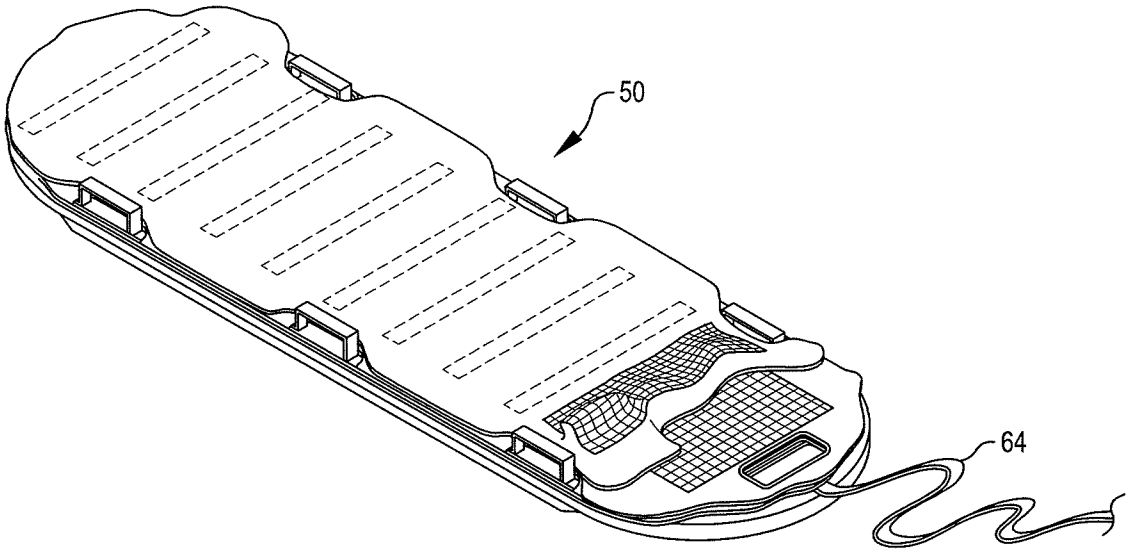
FIG. 8 further illustrates the prototype rescue appliance of FIG. 6, showing protection assembly side flaps folded over the evacuee supporting platform.

Once the evacuee is place in the prone position on the rescue appliance 50, the side flaps 66, 68 of the protection assembly 60 can be folded over the evacuee. FIG. 8 further illustrates the prototype rescue appliance 50 of FIG. 6, showing protection assembly side flaps folded over the evacuee supporting platform.

Figure 9:
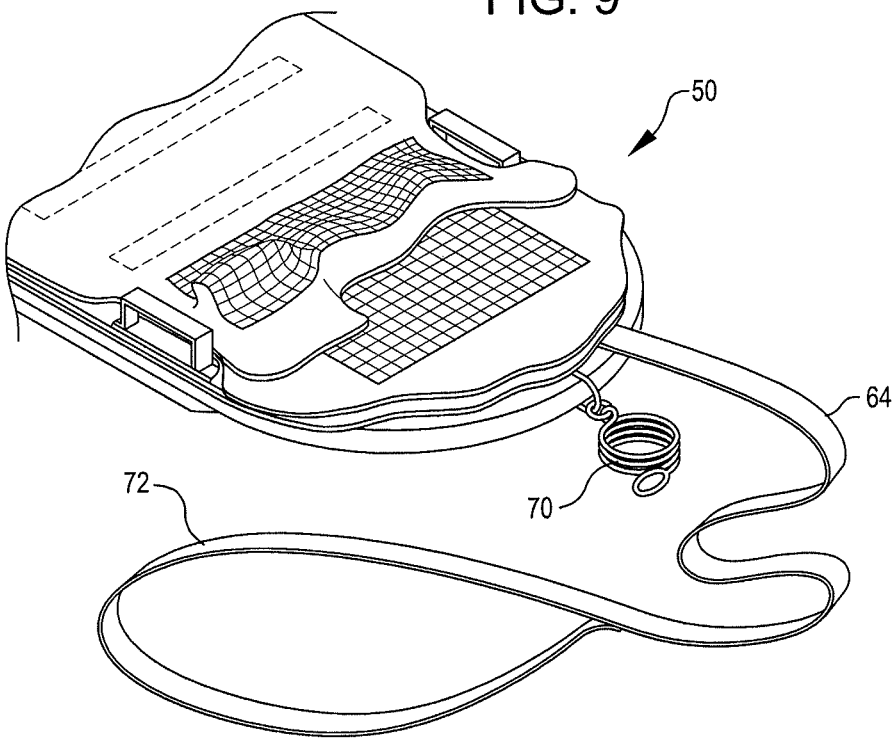
FIG. 9 further illustrates the prototype rescue appliance of FIG. 6, showing a towing tension member used to tow the appliance and a coupling feature to couple the rescue appliance with a second rescue appliance.

FIG. 9 further illustrates the prototype rescue appliance 50 of FIG. 6, showing the towing tension member 64 used to tow the rescue appliance 50, and a coupling feature 70 that can be used to couple the rescue appliance 50 with a second rescue appliance. The towing tension member 64 shown includes an end loop 72, which can be placed around the rescuer (e.g., over a shoulder, around the waist, etc.) so as to free the rescuer's hands for crawling. The coupling feature 70 can include, for example, a short length of cable and a clasp that can be used to couple the rescue appliance 50 with a second rescue appliance.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A rescue appliance, comprising:

a platform configured to support a prone evacuee;

a set of wheels coupled with the platform to support the platform relative to a floor surface;

a unitary protection enclosure fixedly connected to the platform, the protection enclosure configurable to completely encase the prone evacuee to protect the evacuee from a fire.

2. The rescue appliance of claim 1, further comprising a plurality of carrying handles coupled with the platform.

3. The rescue appliance of claim 1, further comprising a towing tension member coupled with the platform for pulling the rescue appliance over the floor surface.

4. The rescue appliance of claim 3, further comprising a coupling feature to couple the rescue appliance with a second rescue appliance.

5. The rescue appliance of claim 1, wherein the evacuee is elevated by less than twelve inches relative to the floor surface.

6. The rescue appliance of claim 5, wherein the evacuee is elevated by less than six inches relative to the floor surface.

7. The rescue appliance of claim 1, wherein each of the wheels comprises a castoring mechanism.

8. The rescue appliance of claim 1, wherein each of the wheels is retractable to permit the rescue appliance to be slid up or down stairs.

9. A rescue appliance comprising:

a platform configured to support a prone evacuee;

a set of wheels coupled with the platform to support the platform relative to a floor surface; and a protection enclosure fixedly connected to the platform, the protection enclosure configurable to substantially encase the prone evacuee to protect the evacuee from a fire, wherein the protection enclosure comprises:

a base portion comprising fire-resistant material disposed on top of the platform so as to be disposed between the evacuee and the platform;

a first longitudinally-oriented flap comprising fire-resistant material, the first flap coupled with a first longitudinal side of the base portion and configurable to at least partially cover the evacuee; and a second longitudinally-oriented flap comprising fire-resistant material, the second flap coupled with a second longitudinal side of the base portion and configurable to substantially overlap the first flap so that the evacuee is surrounded by the base portion, the first flap, and the second flap.

10. The rescue appliance of claim 9, wherein the first and second flaps comprise a plurality of complementary attachment features configured and positioned to secure the second flap relative to the first flap when the first and second flaps cover the evacuee.

11. The rescue appliance of claim 10, wherein the complementary attachment features comprise a hook and loop type fastener.

12. The rescue appliance of claim 11, wherein the complementary attachment features comprise a plurality of hook and loop type fastener strips.

13. The rescue appliance of claim 10, wherein the complementary attachment features comprise a tie-down strap.

14. The rescue appliance of claim 9, wherein the first and second flaps comprise regions configured to cover the evacuee's head and protect the evacuee's head from the fire while allowing the evacuee to breathe.

15. The rescue appliance of claim 14, wherein the head covering regions comprise a fire-resistant material sufficiently permeable to air to allow the evacuee to breathe through the head covering regions.

16. The rescue appliance of claim 9, wherein the rescue appliance is sufficiently buoyant to support the evacuee on water.

17. The rescue appliance of claim 16, wherein the rescue appliance comprises a buoyant perimeter member.

18. The rescue appliance of claim 17, wherein the buoyant perimeter member is removably coupled with the platform.

19. The rescue appliance of claim 16, wherein the rescue appliance comprises an inflatable member.

20. The rescue appliance of claim 19, wherein the protection assembly comprises an inflatable member.

* * * * *